US008246384B1

(12) United States Patent
Wallace

(10) Patent No.: US 8,246,384 B1
(45) Date of Patent: Aug. 21, 2012

(54) VARIABLE CAPACITANCE AUDIO CABLE

(76) Inventor: Henry B. Wallace, Fincastle, VA (US)

( * ) Notice: Subject to any disclaimer, the term of this patent is extended or adjusted under 35 U.S.C. 154(b) by 536 days.

(21) Appl. No.: 12/460,776

(22) Filed: Jul. 24, 2009

Related U.S. Application Data

(60) Provisional application No. 61/135,974, filed on Jul. 25, 2008.

(51) Int. Cl.
*H01R 9/00* (2006.01)

(52) U.S. Cl. ..... 439/620.01

(58) Field of Classification Search ..... 439/620.01; 324/690, 688; 174/386, 102; 330/254, 53, 330/185; 381/61, 77
See application file for complete search history.

(56) References Cited

U.S. PATENT DOCUMENTS

| | | | | |
|---|---|---|---|---|
| 3,379,987 | A * | 4/1968 | Volkers | 330/292 |
| 3,484,679 | A * | 12/1969 | Hodgson et al. | 323/208 |
| 3,774,118 | A * | 11/1973 | Van Doorn | 330/293 |
| 3,803,507 | A * | 4/1974 | Skinner | 330/185 |
| 4,058,765 | A | 11/1977 | Richardson et al. | |
| 4,142,075 | A * | 2/1979 | Olschewski | 379/405 |
| 4,178,485 | A * | 12/1979 | Cowpland et al. | 379/382 |
| 4,376,920 | A * | 3/1983 | Smith | 333/12 |
| 4,496,859 | A * | 1/1985 | Crooks | 327/556 |
| 4,751,471 | A * | 6/1988 | Dunseath, Jr. | 330/53 |
| 4,954,787 | A * | 9/1990 | Brisson | 330/149 |
| 4,996,497 | A * | 2/1991 | Waehner | 330/151 |
| 5,166,679 | A | 11/1992 | Vranish et al. | |
| 5,347,867 | A | 9/1994 | Pangerl | |
| 5,365,783 | A * | 11/1994 | Zweifel | 73/304 C |
| 5,373,245 | A | 12/1994 | Vranish | |
| 5,442,347 | A | 8/1995 | Vranish | |
| 5,493,070 | A * | 2/1996 | Habu | 174/102 R |
| 5,519,329 | A * | 5/1996 | Satterwhite | 324/690 |
| 5,574,249 | A * | 11/1996 | Lindsay | 174/386 |
| 5,726,581 | A * | 3/1998 | Vranish | 324/688 |
| 5,759,069 | A * | 6/1998 | Kitatani et al. | 439/675 |
| 5,973,415 | A | 10/1999 | Brenner et al. | |
| 6,018,596 | A * | 1/2000 | Wilkinson | 382/260 |
| 6,023,513 | A * | 2/2000 | Case | 381/61 |
| 6,033,370 | A | 3/2000 | Reinbold et al. | |
| 6,223,814 | B1 * | 5/2001 | Moresco et al. | 165/185 |
| 6,335,973 | B1 * | 1/2002 | Case | 381/61 |
| 6,542,717 | B1 | 4/2003 | Zimmerman et al. | |
| 6,597,164 | B2 | 7/2003 | Olson | |
| 6,606,388 | B1 * | 8/2003 | Townsend et al. | 381/17 |
| 6,664,820 | B1 * | 12/2003 | Estrada | 327/108 |
| 6,681,630 | B1 | 1/2004 | Kumada et al. | |
| 6,825,765 | B2 | 11/2004 | Stanley et al. | |
| 6,847,354 | B2 | 1/2005 | Vranish | |
| 7,277,267 | B1 * | 10/2007 | Bonin | 361/290 |
| 7,310,228 | B2 * | 12/2007 | Chen | 361/695 |
| 7,582,842 | B2 * | 9/2009 | D'Amario | 219/69.13 |
| 7,887,377 | B1 * | 2/2011 | Wallace | 439/669 |
| 8,075,342 | B1 * | 12/2011 | Harney et al. | 439/620.01 |
| 2005/0237068 | A1 * | 10/2005 | Nakashita et al. | 324/539 |
| 2007/0139113 | A1 * | 6/2007 | Ra et al. | 330/254 |
| 2008/0190642 | A1 * | 8/2008 | Allen et al. | 174/102 R |

OTHER PUBLICATIONS

Atlantic Quality Design, Inc., The Zerocap(Tm) Audio Cable, Web Page http://www.aqdi.com/zerocap.htm, Printed on Jul. 24, 2009.

* cited by examiner

*Primary Examiner* — Alexander Gilman

(57) ABSTRACT

The variable capacitance audio cable allows adjustment of the frequency response of the system in which the cable is used by varying the cable capacitance electronically. This permits musical performers using the cable to tailor the audio response to suit their performance and style.

9 Claims, 6 Drawing Sheets

VARIABLE CAPACITANCE AUDIO CABLE

PRIORITY

This application claims priority through U.S. Provisional Application No. 61/135,974 filed by Henry B. Wallace on Jul. 25, 2008 for "Low Capacitance Audio Cable."

BACKGROUND OF THE INVENTION

1. Field of the Invention

The variable capacitance audio cable relates to the transmission of audio information from a source (typically a guitar or musical instrument) to a sink (typically an audio amplifier or other audio processing equipment).

2. Description of the Prior Art

An audio cable is intended to connect a source of audio information to a consumer or sink for that information, typically an amplifier, which amplifier may have a connected loudspeaker, or may be a front end for other processing such as a computer. A special case of this arrangement occurs when a musical instrument containing one or more sound pickups is connected to an audio amplifier. This case is of interest because of the nature of the sound pickups, which in the majority have a passive construction. Such passive sound pickups (or simply pickups) have a high output impedance in the general range of a few thousand to twenty five thousand ohms, and as such are susceptible to the effects of the interelectrode capacitance of the audio cable used to connect the instrument to the amplifier. If, however, the pickup or audio source has a low output impedance (in the case of a preamplified pickup), then the capacitance of the audio cable is of little consequence and causes practically no audible degradation in the frequency response of the source audio information.

Well known in the prior art is an electronic technique for reducing the capacitance of an audio cable, described presently. Audio cables typically have coaxial construction, with a center conductor (or wire), a dielectric layer, a co-axial, cylindrical shield made of spiraled or braided conductors, or a metal foil layer, or both, and an overall insulating layer. The capacitance between the center conductor and the shield ranges generally from 10 picofarads/foot (pf/ft) to 60 pf/ft or more, depending on the specific geometries and dielectric involved.

To reduce the interelectrode capacitance of the cable, a second shield layer is interposed between the original shield and the center conductor, and insulated from both. This second shield is driven with a buffered version of the signal on the center conductor, produced with a noninverting unity gain voltage amplifier. The net result is that the AC voltage between the center conductor and the driven second shield is zero, and thus zero AC current flows through the cylindrical capacitor structure of the audio cable from center conductor to outer shield, making it appear to the audio source (or pickup) as if the cable has zero capacitance. The outer shield of the cable provides overall shielding and a return (also called 'ground') path for current flowing in the center conductor. The driven shield conductor, being driven with a low output impedance voltage amplifier, also acts as an additional shield against noise sources that might otherwise affect the signal on the center conductor of the cable.

Note that the noninverting unity gain amplifier effectively has its output and input coupled together through the capacitance in the audio cable. While technically a unity gain amplifier would oscillate under these conditions, in reality a unity gain operational amplifier or equivalent sees a loop gain slightly less than one due to imperfections in the system, such as conductor resistance and a finite amplifier output impedance, so that the system does not oscillate. Please note that while the term "unity gain" is used herein, it should always be understood that the loop gain must be less than one to ensure no oscillations will occur.

This capacitance reduction technique is common in the prior art and is used by electrical engineers to mitigate the effects of capacitance when connecting high impedance sensors through cables to measurement equipment. This technique is even used in integrated circuit structures to reduce the effects of interelectrode capacitance.

For example, Bonin (U.S. Pat. No. 7,277,267, Oct. 2, 2007) states, "Avoiding this parasitic capacitance was done by feeding a unity gain buffered replica of the pickup electrode signal to the driven shields."

Vranish (U.S. Pat. No. 6,847,354, Jan. 25, 2005) states, "Thus, the system performs as a multi-pixel sensor array in which all pixels and the driven shield are at the same voltage and at all times in phase." This invention deals with interactive displays.

Kumada, et al. (U.S. Pat. No. 6,681,630, Jan. 27, 2004) discloses a vibrating gyroscope that uses the driven shield approach in its measurements, and states, "According to the above-explained structure, shields 8*a* and 8*b* are biased or driven with an electric potential which is the same as the electric potential of the detection signals transmitted via the wirings 7*a* and 7*b*. As a result, the surrounding of the wirings 7*a* and 7*b* are kept at an electric potential which is the same as the detection signals transmitted via the wirings 7*a* and 7*b*, thereby preventing a parasitic capacitances from being produced."

There are many more examples in the prior art of such driven shield designs, including: Olson (U.S. Pat. No. 6,597,164, Jul. 22, 2003), Richardson, et al. (U.S. Pat. No. 4,058,765, Nov. 15, 1977), Zimmerman, et al. (U.S. Pat. No. 6,542,717, Apr. 1, 2003), Stanley, et al. (U.S. Pat. No. 6,825,765, Nov. 30, 2004), Reinbold, et al. (U.S. Pat. No. 6,033,370, Mar. 7, 2000), Brenner, et al. (U.S. Pat. No. 5,973,415, Oct. 26, 1999), Vranish (U.S. Pat. No. 5,726,581, Mar. 10, 1998), Satterwhite (U.S. Pat. No. 5,519,329, May 21, 1996), Vranish (U.S. Pat. No. 5,442,347, Aug. 15, 1995), Vranish (U.S. Pat. No. 5,373,245, Dec. 13, 1994), Zweifel (U.S. Pat. No. 5,365,783, Nov. 22, 1994), Pangerl (U.S. Pat. No. 5,347,867, Sep. 20, 1994), Vranish, et al. (U.S. Pat. No. 5,166,679, Nov. 24, 1992), and Dunseath, Jr. (U.S. Pat. No. 4,751,471, Jun. 14, 1988). For brevity, the quotations have not been included here.

All of these patents describe the driven shield technique that includes, and includes only, a driving of a shield conductor with a signal that is a one-to-one replica in amplitude, frequency, and phase of the signal appearing on the structure or conductor being shielded. These applications are diverse and cover many areas of invention.

However, the prior art does not disclose, and, in teaching only a unity gain buffer amplifier, ignores the use of a non-unity gain transfer function in the circuitry that drives the driven shield. The important and unexpected benefits of this new configuration are described following.

When an audio cable is connected to a sound pickup, that cable affects the frequency response of the signal conveyed to the amplifier. If the pickup has a resistive (non-complex) output impedance, the output impedance and the cable capacitance work together to lowpass filter the audio signal. If the pickup has an inductive character, as with pickups used on many stringed musical instruments, then the cable capacitance, pickup resistance, pickup shunt capacitance, and pickup inductance work together to create a second order lowpass filter that may have a resonant peak near the cutoff frequency, depending on the damping factor of the transfer function. The specific values of pickup impedance, cable capacitance, and amplifier input impedance determine the particular frequency response that results, but the cutoff frequency is generally in the audio frequency range between a few hundred and a few thousand Hertz.

Players of stringed musical instruments that use inductive magnetic pickups in particular are keenly aware of the affect of cable capacitance on the tone of the audio being produced by their instruments. Such magnetic pickups are used to sense the vibrations of ferromagnetic strings on the instrument. Musicians experiment at great length with various brands and configurations of audio cables, pickups and amplifiers to obtain a sound that enhances their performance.

Until now, the cables available to musicians have mostly been passive in nature (containing no active electronics), having a cable capacitance fixed by cable geometry. Musicians are in the main not educated in technical matters and may not fully understand the concept of cable capacitance, and thus only understand the rudiments of this phenomenon, that is, a longer cable reduces high frequencies more than a shorter cable of the same type. A musician must experiment by purchasing individual audio cables and evaluating the effects on the sound of the instrument, and this can be a time consuming and expensive proposition.

Many musical instruments with sound pickups have integrated tone controls which simply add more capacitance on the pickup signal wire, thus reducing high frequency response. However, there is no way to selectably or variably reduce the capacitance of the pickup-cable-amplifier system below that of the audio cable, using prior art inventions.

It is possible to eliminate the effects of cable capacitance entirely by installing a buffer amplifier in the instrument or cable. Such amplifiers typically have a high impedance input (which does not appreciably load the sound pickup) and a low impedance output. The low output impedance raises the cutoff frequency of the lowpass filter formed by the amplifier output impedance and shunt cable capacitance. However, due to the impedance transformation of the amplifier, this buffer amplifier changes the dynamic feel of the instrument to the musician, who interacts not only with the instrument, but also with the amplifier and loudspeakers during a performance, sometimes incurring intentional oscilliatory feedback between the instrument and loudspeakers. For this reason, most instrumentalists avoid actively amplified instruments and cables.

An advantage of the driven shield approach to cable capacitance elimination is that the galvanic connection between the instrument and the amplifier is not disturbed. The only net effect is an elimination of cable capacitance, and not any fundamental impedance change to the instrument itself.

What is needed is a way to vary the capacitance of an audio cable, from a very low value up to the natural capacitance dictated by the geometry of the cable. Further, tailoring the frequency and phase response of the amplifier that drives the shield changes the overall response of the pickup-cable-amplifier system and presents new tonal opportunities to the musician.

Objects and Advantages of the Variable Capacitance Audio Cable

Several objects and advantages of the variable capacitance audio cable are:

1. Varying the capacitance of the audio cable allows the musician to explore tonalities heretofore not available.
2. Varying the frequency, amplitude and phase response of the amplifier driving the driven shield allows the musician to explore tonalities heretofore not available.
3. This technique has the benefit of decoupling the cable geometry from the capacitance of the cable, allowing separate optimization of physical and audio performance parameters by the cable manufacturer.
4. Elimination or reduction of the cable capacitance gives the instrument's tone control a wider range of subjective tonal variation than that had when using a standard capacitive audio cable.
5. Elimination or reduction of the cable capacitance prevents the instrument's volume control from creating a lowpass filter effect that robs the instrument of tone at low playing volumes.
6. The instrument is connected galvanically to the amplifier without intervening buffer amplifiers or impedance converters, preserving what many instrumentalists consider the 'organic' feel of the instrument/amplifier system.
7. The electronic circuitry used to reduce or eliminate the cable capacitance may be located at any point along the audio cable, or in the instrument, or in the amplifier to which the audio cable connects, as is convenient and economical.

SUMMARY OF THE INVENTION

The variable capacitance audio cable allows adjustment of the frequency response of the system in which the cable is used by varying the cable capacitance electronically. This permits musical performers using the cable to tailor its audio response to suit their performance, taste, and style.

DETAILED DESCRIPTION

Driven shield arrangements require three conductors in a cable, typically a triaxial cable with a center conductor and two tubular shields (or a center conductor, one tubular shield, and a ground return wire), and an overall insulating layer. Such a cable structure is well known in the prior art. The center conductor carries the signal of interest. A second conductor is arranged as a shield around the center conductor, separated by a first dielectric. An optional semi-conductive layer situated around the outer surface of the first dielectric helps to reduce noise caused by mechanical motion of the cable's components (not shown in the figures). A third conductor is typically arranged as an additional shield, situated around the second conductor shield, separated by a second dielectric as well, though the third conductor could be a single wire insulated from the second conductor shield. With this arrangement, a unity gain amplifier samples the signal on the center conductor and drives that signal into the second conductor, or driven shield. The third conductor (an outer shield or wire) serves as the return path for current flowing in the center conductor. The ground reference for the amplifier and signal is the third conductor.

Prior art driven shield cable capacitance reduction circuits use a unity gain amplifier to drive the driven shield. This results in a reduction in the cable capacitance to typically some few picofarads or tens of picofarads, measurable between the center conductor and outer (non-driven) shield. This is useful, but more useful would be the ability to vary the capacitance continuously or in steps. Such variable capacitance in particular is beneficial to musicians in search of nuances of audio tone, which are not attainable with standard passive audio cables, or actively amplified instruments or cables.

Figure 1:
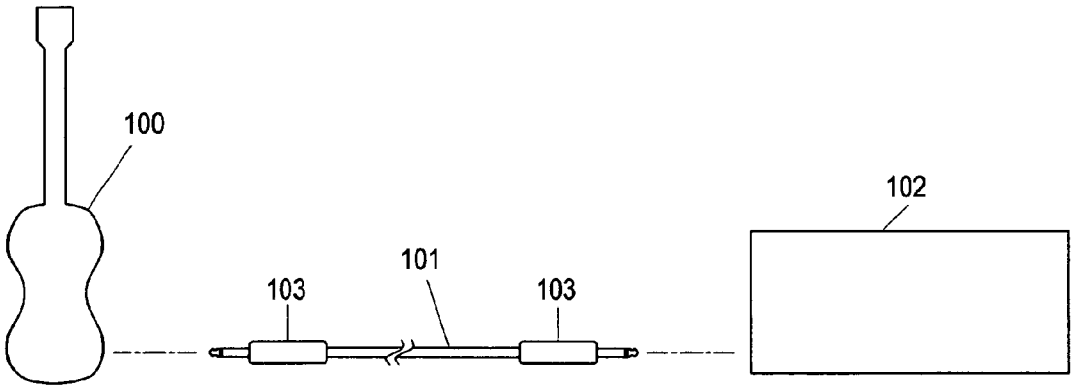
FIG. 1 (PRIOR ART)
FIG. 1 is a sketch of a typical connection of a musical instrument through a coaxial audio cable to an amplifier.

FIG. 1 shows a typical arrangement of an instrument 100 (for example, a guitar), a two-conductor, coaxial shielded audio cable 101 with audio connectors 103, and an amplifier 102 which is typically a musical instrument amplifier with attached loudspeaker, though this could be front end amplification for other audio processing such as a computer. The coaxial cable has a natural capacitance between its center conductor and shield which is determined by its geometry and materials, readily computed using elementary equations of physics, and easily measured by electronic instruments. This capacitance has heretofore only been variable to the extent that the musician can use cables of various lengths, one at a time.

Figure 2:
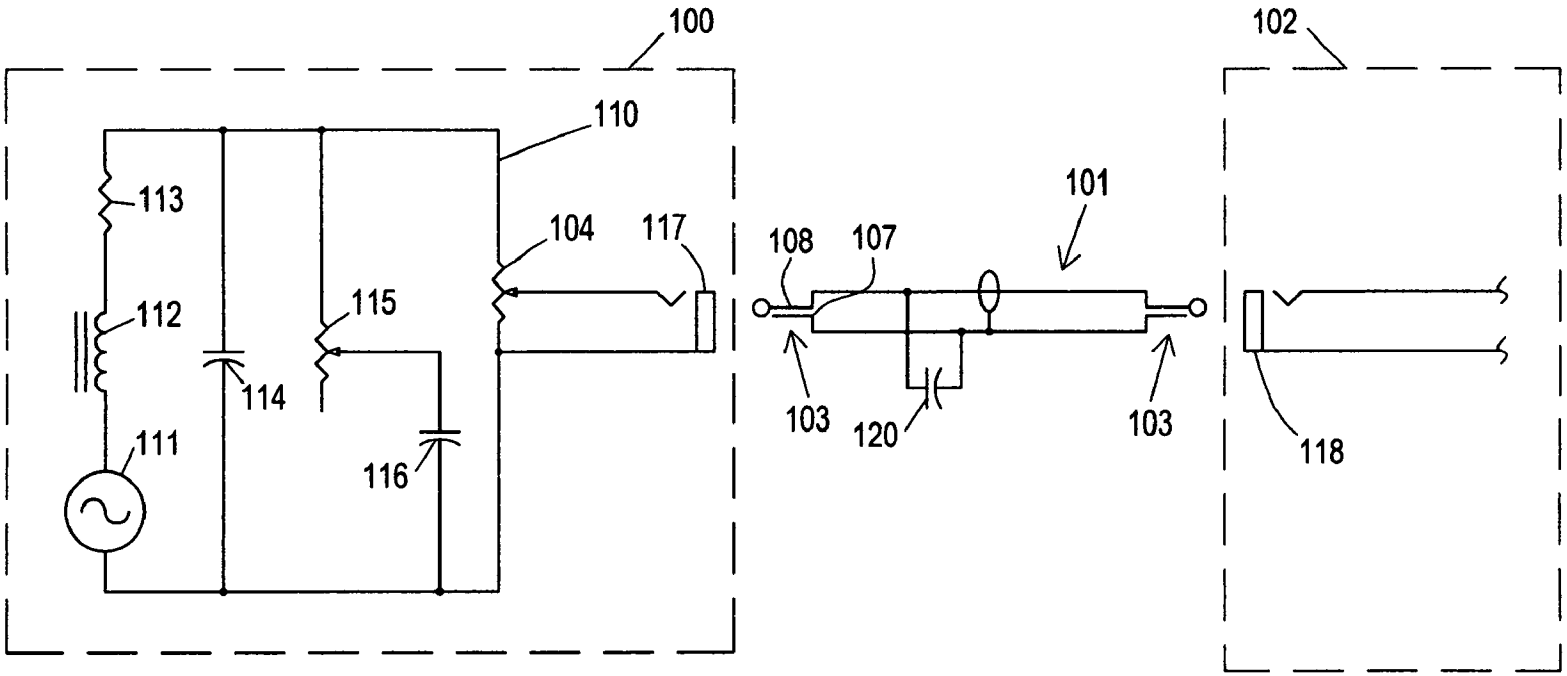
FIG. 2 (PRIOR ART)
FIG. 2 is a schematic representation of the equivalent circuit of FIG. 1.

FIG. 2. shows a schematic representation of the equivalent of circuits appearing in the instrument 100, the coaxial audio cable 101, and an input connector 118 of amplifier 102. A single inductive pickup is depicted, but this circuit may be interpreted as the equivalent circuit of a multiple pickup arrangement, without loss of generality. Such pickups consist of many turns of copper wire wound around a magnetized core, and these pickups are useful for sensing the vibrations of ferromagnetic strings on the instrument. Inductive pickups have an equivalent circuit consisting of an ideal AC voltage source 111, an equivalent inductance of the pickup coil 112, an equivalent resistance of the coil's wire 113, and an equivalent interwinding capacitance 114 of the coil.

Audio connectors 103 are shown schematically in FIG. 2. These contain a signal terminal 108 and a shield terminal 107.

Many instruments contain a tone control potentiometer 115 which varies the resistance between an additional shunt capacitance 116 and a signal conductor 110. (There are various ways to wire tone controls, and this method is shown for the purposes of illustration. These methods are not critical to the structure of the variable capacitance audio cable.)

The audio output of the instrument appears at a connector 117 in the instrument 100, after passing through a volume control 104. The audio signal is conducted through a coaxial audio cable 101 having a characteristic interelectrode capacitance 120, shown schematically as a discrete capacitor, but actually being distributed along the length of the cable uniformly. The cable typically plugs into an audio amplifier 102 at the input connector 118, and plugs into the instrument 100 at connector 117.

The schematic in FIG. 2 is sufficient to represent instruments with multiple inductive pickups because such pickups connected in series or parallel by switches in the instrument may be reduced to an equivalent circuit containing the basic elements depicted, including the equivalent inductance 112, equivalent resistance 113, equivalent capacitance 114, and ideal voltage source 111.

It is seen from FIG. 2 that the frequency response of the system, from the pickup to the input of the amplifier, is user-variable mainly using the tone control 115 on the instrument 100, and by selecting different audio cables 101. Further, the shunt capacitance of the system cannot be reduced below that capacitance 120 supplied by the audio cable. The volume control 104 affects the frequency response of the system as it interacts with the cable capacitance 120 to roll off high frequencies, and this effect varies with the position of the volume control 104.

Figure 3:
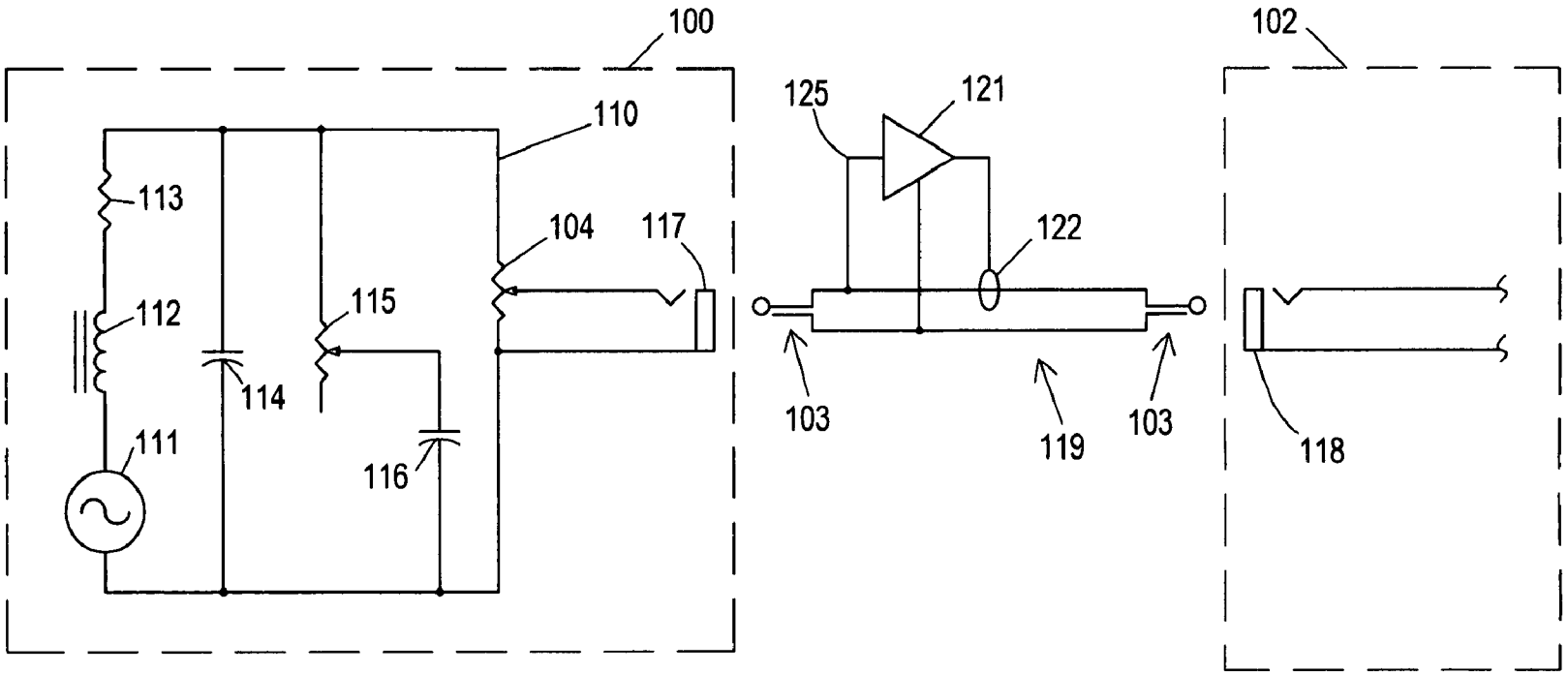
FIG. 3 (PRIOR ART)
FIG. 3 is a schematic representation of the equivalent circuit of FIG. 1, but replaces the coaxial cable with a unity gain buffer driving a second shield in a triaxial cable.

FIG. 3 shows the circuit with a unity gain buffer amplifier 121 driving a second shield 122 in a three-conductor, triaxial audio cable 119, the second shield 122 running the length of the cable. The amplifier 121 has an input 125 that is connected to the center signal conductor in the cable 119, and the amplifier's input impedance is selected to be high enough so as not to load the signal coming from the instrument's connector 117 appreciably. The output of the buffer amplifier is connected to drive the second shield 122 in the cable 119. With this arrangement, the capacitance of the cable (between center conductor and outer shield) is reduced substantially, but is not variable. Note that the point of placement of the amplifier 121 may be anywhere along the cable, or even inside the instrument 100 or amplifier 102, with use of connectors having a suitable number of conductors (an option addressed following).

Figure 4:
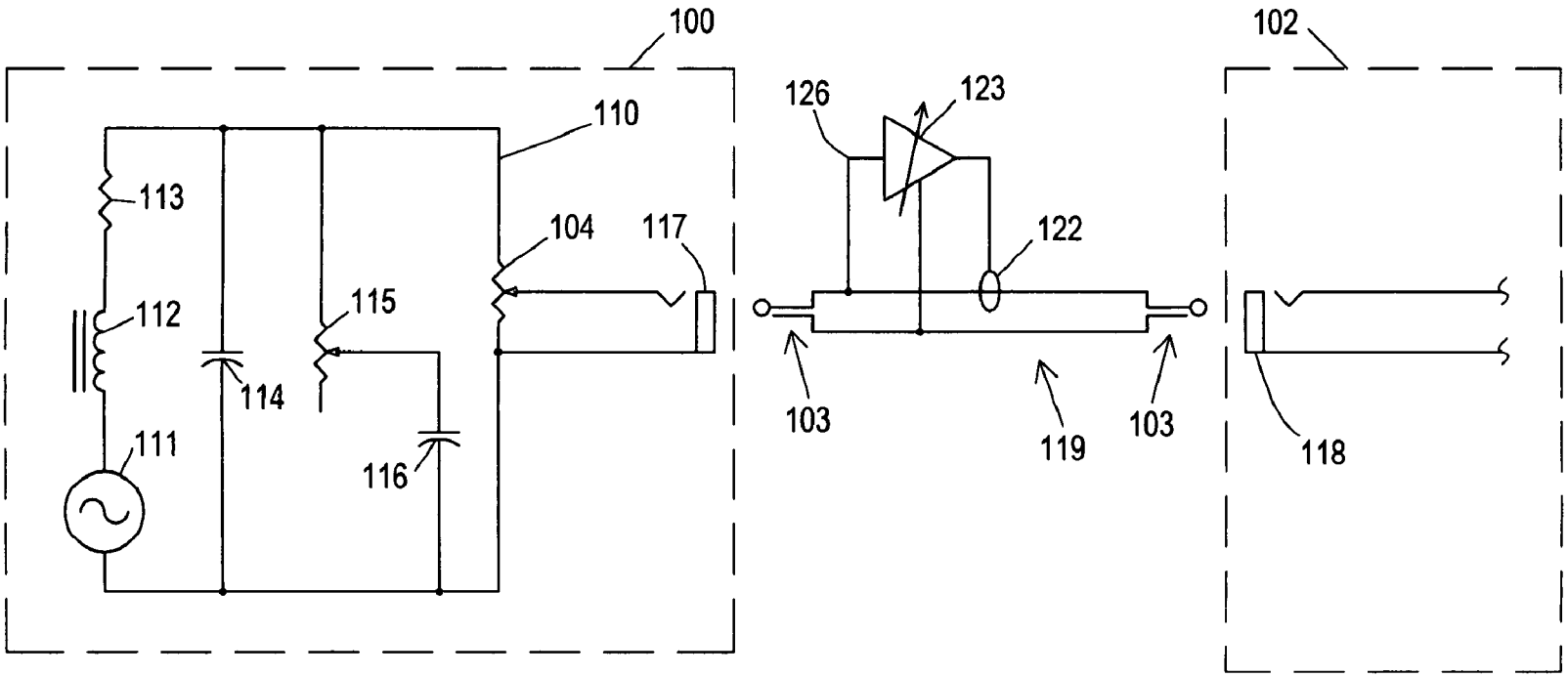
FIG. 4 is a schematic representation of the equivalent circuit of FIG. 1, but replaces the coaxial cable with a variable gain amplifier driving a second shield in a triaxial cable.

FIG. 4 shows the circuit with a variable gain buffer amplifier 123 driving a second shield 122 in a three-conductor, triaxial audio cable 119, the second shield 122 running the length of the cable. The amplifier 123 has an input 126 is connected to the center signal conductor in the cable 119, and the amplifier's input impedance is selected to be high enough so as not to load the signal coming from the instrument's connector 117 appreciably. The output of the buffer amplifier is connected to drive the second shield 122 in the cable 119. With this arrangement, the capacitance of the cable (between center conductor and outer shield) is variable between values of some few picofarads (for a gain of one) and the characteristic capacitance of the cable (for a gain of zero). Note that the point of placement of the amplifier 123 may be anywhere along the cable, or even inside the instrument 100 or amplifier 102 with use of connectors having a suitable number of conductors (an option addressed following). The only restriction on the amplifier gain is that the gain of the loop consisting of the amplifier 123 and the cable capacitance (not depicted) must be less than unity at all frequencies, to prevent oscillation.

PREFERRED EMBODIMENT

Figure 5:
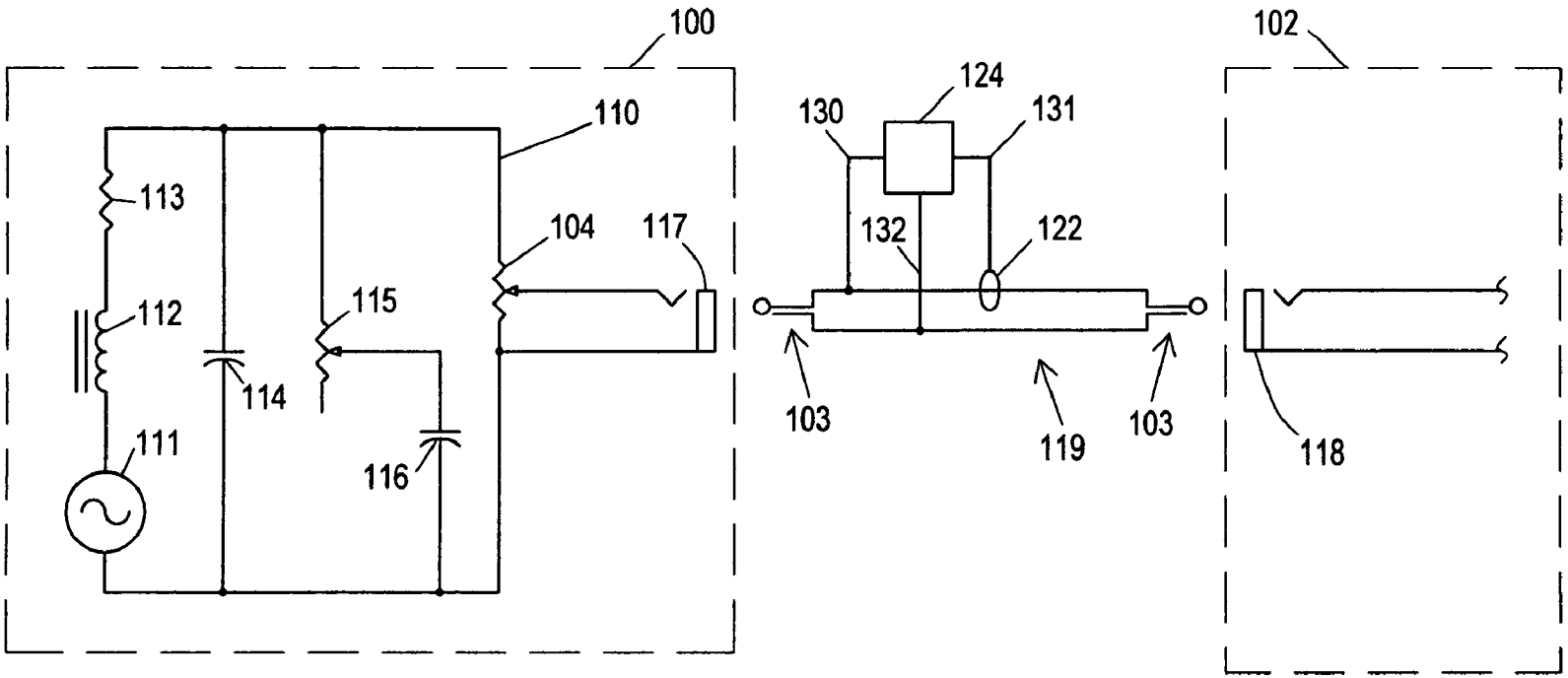
FIG. 5 is a schematic representation of the equivalent circuit of FIG. 1, but replaces the coaxial cable with a generalized amplifier transfer function driving a second shield in a triaxial cable.

FIG. 5 shows the circuit of the preferred embodiment with a general transfer function 124 driving a second shield 122 in a three-conductor, triaxial audio cable 119, the second shield 122 running the length of the cable. The only restriction on the transfer function is that the gain of the loop consisting of the transfer function 124 and the cable capacitance must be less than unity at all frequencies, to prevent oscillation. The transfer function 124 may be fixed, or variable continuously or in steps, and may be tailored to produce tonalities pleasing to the musician. As an example, the transfer function 124 may be a notch, allpass, bandpass, lowpass, or highpass filter, with variable gain at one or more frequencies, and a nonuniform frequency or phase response. The transfer function 124 has an input 130, an output 131, and a ground reference 132.

The unity gain amplifier 121, variable gain amplifier 123, and transfer function 124 are electronic circuits readily crafted by persons skilled in the art, and are not described here on a detailed component level. Not limiting potential embodiments, typical arrangements comprise transistor and/or operational amplifier circuits, which are well known in the art.

A disadvantage of capacitive passive audio cables is that the volume control 104 works with the cable capacitance 120 (see FIG. 2) to create a variable cutoff frequency resistor-capacitor lowpass filter, whose cutoff frequency is a function of the position of the volume control. The effect is that high frequencies are increasingly attenuated as the instrument's volume is reduced. This is an unpleasing effect and is perceived as a lack of tone by the musician if the volume is reduced, for example, to play through a quiet section of a song. An advantage of the arrangement of FIG. 5 is that the reduction of cable capacitance reduces or eliminates this effect as the volume control 104 is changed. Thus the tone of the instrument is not reduced in high frequency content at reduced volume levels.

Elimination or reduction of the cable capacitance also gives the tone control 115 a wider range of subjective tonal variation than that had when using a standard capacitive audio cable. Many musicians leave the instrument's tone control 115 set to the 'minimum additional capacitance' setting, because the cable capacitance is already reducing the high frequency response of the instrument in an unacceptable way. With the variable capacitance audio cable, the tone control becomes useful to the musician.

ALTERNATIVE EMBODIMENTS

Figure 6:
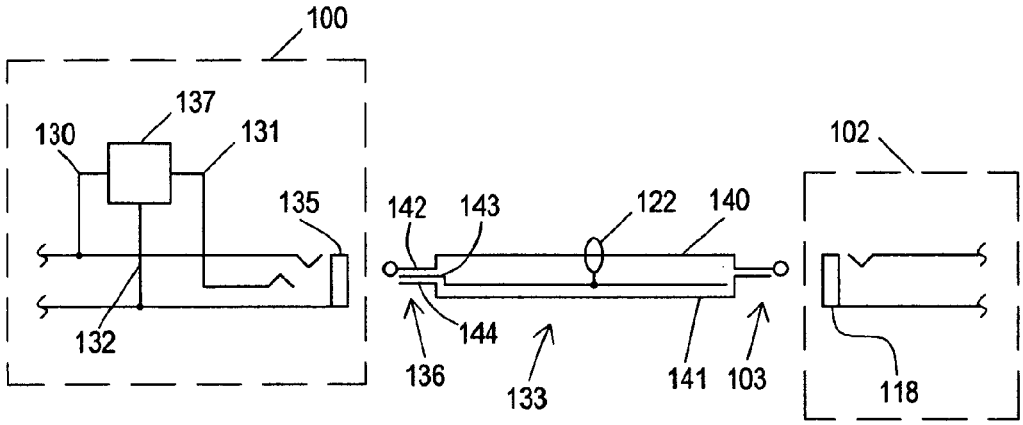
FIG. 6 illustrates how the generalized amplifier transfer function may be located in the musical instrument.

FIG. 6 shows an alternative embodiment with a shield driver amplifier or transfer function 137 located within the instrument 100. The transfer function 137 has an input 130, an output 131, and a ground reference 132, and connects to a three-conductor jack (also called a stereo, or tip, ring, and sleeve jack) 135. A triaxial audio cable 133 contains a center conductor 140, driven shield 122, and a ground return wire or shield 141. A three-conductor plug 136 connects to the three-conductor jack 135 to convey the audio signal, shield driver signal, and ground return signal to the cable 133. Three-conductor plug 136 contains a signal terminal 142, a shield terminal 144, and a driven shield terminal 143. On the musical instrument amplifier 102, a two-conductor plug 103 connects to a two-conductor jack 118. It is not necessary that the driven shield 122 be connected to the musical instrument amplifier 102 as its only purpose is to reduce the cable capacitance of the audio cable 133.

Figure 7:
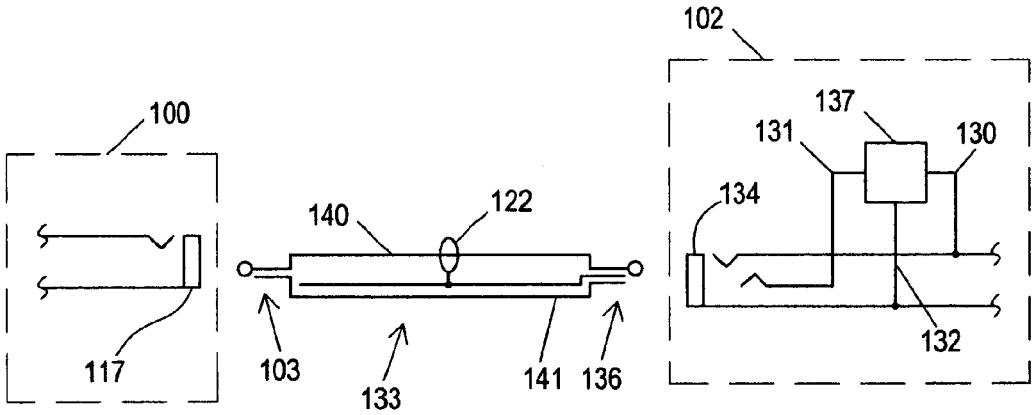
FIG. 7 illustrates how the generalized amplifier transfer function may be located in the musical instrument amplifier.

FIG. 7 shows an alternative embodiment with a shield driver amplifier or transfer function 137 located within the musical instrument amplifier 102. The transfer function 137 has an input 130, an output 131, and a ground reference 132, and connects to a three-conductor jack (also called a stereo or tip, ring, and sleeve jack) 134. An audio cable 133 contains a center conductor 140, driven shield 122, and a ground return wire or shield 141. A three-conductor plug 136 connects to the three-conductor jack 134 to convey the audio signal, shield driver signal, and ground return to the cable 133. On the instrument 100 side, a two-conductor plug 103 connects to a two-conductor jack 117. It is not necessary that the driven shield 122 be connected to the instrument 100 as its only purpose is to reduce the cable capacitance of the audio cable 133.

All three locations of the shield driver amplifier or transfer function are electronically equivalent. However, there may be advantages to mounting it in one location over the others, depending on the application, such as the availability of power or mounting space, or the desire to minimize modifications to a valuable antique instrument or amplifier.

In the above description, the amplifier or transfer function used to drive the driven shield is powered by any practical means. The source of power is immaterial to the function of the audio cable regarding variation of the cable capacitance. The source of power may be chosen based on practical considerations such as space and cost.

Note that one way to make the cable capacitance variable is by enabling or disabling power to the amplifier or transfer function, as long as the depowered amplifier or transfer function does not unduly load the audio signal or cause distortion. In this case, when the amplifier or transfer function is powered, the capacitance has some selected value based on its gain and response. When depowered, the capacitance rises to the natural capacitance of the cable.

The generalized driven shield technique has the benefit of decoupling the cable geometry from the capacitance of the cable, allowing separate optimization of physical and audio performance parameters by the cable manufacturer. Musicians prefer audio cables in a certain diameter range (typically 4 mm to 6 mm), with great flexibility and durability, and wide frequency response. These goals are in opposition to the goal of low capacitance in a passive cable, but are separately tunable using the variable capacitance audio cable.

Marketing of the variable capacitance audio cable, after the filing of U.S. Provisional Application No. 61/135,974, has resulted in comments from professional musicians praising the enhanced tonal range that it provides, after they have purchased and used an embodiment of the cable.

The specific configuration of the embodiments discussed should not be construed to limit implementation of the variable capacitance audio cable to those embodiments only. The techniques outlined are applicable to embodiments in other physical formats, using various power sources, using various electronic amplifier and transfer function topologies, using various ways in which to make the amplifier gain or transfer function variable, such variability being accomplished in one or more of the amplitude, frequency, or phase domains. Other embodiments may use analog or digital processing techniques, and/or implement or simulate or emulate the invention substantially in software or digital hardware. These techniques may be applied to balanced as well as the unbalanced audio circuits shown herein. The variable capacitance audio cable is functional with the broad range of instruments used by musicians, which convey sound signals from instrument to an amplifier and loudspeaker, or processing equipment. The variable gain amplifier or transfer function can be built into an amplifier, instrument, or mounted on the audio cable itself or its attached connectors. The conductors in the triaxial cable do not have to be strictly cylindrical, but could be of other shapes as long as the basic structure remains. These techniques, structures and methods find applicability outside the realm of musical instruments and related amplification, including but not limited to industrial electronics applications. The term, "variable," as applied to the variable capacitance audio cable, is to be construed as "continuously variable" and also as "selectable," where the resulting cable capacitance and system frequency response may be selected from among a set of one or more discrete values, either during manufacture or by the user. Therefore, the scope of the invention should be determined not by the embodiments illustrated, but by the appended claims and their legal equivalents.

What is claimed is:

1. An audio cable means for use with musical instruments employing passive pickups, which comprises:

(a) a first conductor having a first end and a second end; and (b) a second shield conductor, having a first end and a second end, disposed tubularly around said first conductor, separated by a first dielectric therefrom; and (c) a third conductor, having a first end and a second end, situated external to said second shield conductor, separated by a second dielectric therefrom; and (d) an overall insulating layer; and (e) a first connector having at least a signal terminal and a shield terminal, with said first end of said first conductor connected to said signal terminal, and with said first end of said third conductor connected to said shield terminal; and (f) a second connector having at least a signal terminal and a shield terminal, with said second end of said first conductor connected to said signal terminal, and with said second end of said third conductor connected to said shield terminal; and (g) a manually controlled electronic amplifier whose input is connected to said first conductor and whose output is connected to said second shield conductor, said electronic amplifier having an overall variable gain from zero to a maximum gain, said maximum gain being less than unity at all frequencies, said electronic amplifier having a transfer function selected from the group consisting of notch filter, allpass filter, bandpass filter, lowpass filter, highpass filter, and nonuniform frequency response filter;

whereby said variation in gain of said electronic amplifier changes the interelectrode capacitance between said first conductor and said third conductor of said audio cable means from a first capacitance at the highest said overall variable gain to a second capacitance at a said overall variable gain of zero, said first capacitance measured at any single frequency being inversely proportional to the specific gain of said electronic amplifier at said single frequency, said second capacitance being the characteristic said interelectrode capacitance of said audio cable means.

2. The audio cable means of claim 1 wherein the manual control means is provided to control said overall variable gain of said electronic amplifier, whereby said manual control means is actuable by the musician who is using said audio cable, to produce pleasing tonalities.

3. The audio cable means of claim 1 wherein the manual control means is provided to select said transfer function of said electronic amplifier, whereby said manual control means is actuable by the musician who is using said audio cable, to produce pleasing tonalities.

4. The audio cable means of claim 1 wherein said transfer function of said electronic amplifier is selected from said group during manufacture of said audio cable means.

5. The audio cable means of claim 1 wherein said first dielectric has disposed on its outer surface a semi-conductive layer.

6. A method of varying the interelectrode capacitance of an audio cable, said audio cable for use with musical instruments employing passive pickups, which comprises:

(a) providing an audio cable means comprised of a first conductor, a second shield conductor disposed around said first conductor and separated by a first dielectric therefrom, a third conductor situated external to said second shield conductor and separated by a second dielectric therefrom, and an overall insulating layer; and (b) providing a manually controlled electronic amplifier whose input is connected to said first conductor and whose output is connected to said second shield conductor, said electronic amplifier having an overall variable gain from zero to a maximum gain, said maximum gain being less than unity at all frequencies, and having a transfer function selected from the group consisting of notch filter, allpass filter, bandpass filter, lowpass filter, highpass filter, and nonuniform frequency response filter;

whereby said variation in gain of said electronic amplifier changes the interelectrode capacitance between said first conductor and said third conductor of said audio cable from a first capacitance at the highest said overall variable gain to a second capacitance at a said overall variable gain of zero, said first capacitance measured at any single frequency being inversely proportional to the specific gain of said electronic amplifier at said single frequency, said second capacitance being the characteristic said interelectrode capacitance of said audio cable.

7. The method of claim 6 wherein the method of variation of said overall variable gain of said electronic amplifier is actuation of the manual control, whereby said manual control is actuable by the musician who is using said audio cable to produce pleasing tonalities.

8. The method of claim 6 wherein the method of selection of said transfer function of said electronic amplifier is actuation of the manual control, whereby said manual control is actuable by the musician who is using said audio cable to produce pleasing tonalities.

9. The method of claim 6 wherein the method of selection of said transfer function of said electronic amplifier is selection of a transfer function during manufacture of said audio cable.

* * * * *